US005934633A

United States Patent [19]

Padiak et al.

[11] Patent Number: 5,934,633

[45] Date of Patent: Aug. 10, 1999

[54] PIVOTAL, TWO-POSITION LOCKING SIGN MOUNTING SYSTEM

[75] Inventors: Scott Padiak, Winnetka; Thomas M. Conway, Chicago, both of Ill.

[73] Assignee: Cormark, Inc., Rosemont, Ill.

[21] Appl. No.: 09/046,748

[22] Filed: Mar. 24, 1998

[51] Int. Cl.[6] ..... G09F 7/00

[52] U.S. Cl. ..... 248/228.8; 40/492; 40/642.02; 248/291.1; 248/292.14; 248/214

[58] Field of Search ..... 248/291.1, 292.14, 248/214, 228.8, 230.8; 40/492, 642.02

[56] References Cited

U.S. PATENT DOCUMENTS

| | | | |
|---|---|---|---|
| Re. 30,734 | 9/1981 | Eckert . | |
| 268,616 | 12/1882 | Brown . | |
| 629,021 | 7/1899 | True | 248/291.1 X |
| 1,111,458 | 9/1914 | Hight . | |
| 1,199,848 | 10/1916 | Willoughby | 248/291.1 X |
| 1,220,758 | 3/1917 | Lamphiear . | |
| 1,559,010 | 10/1925 | Schwieger . | |
| 1,793,563 | 2/1931 | Schwartz . | |
| 1,866,723 | 7/1932 | Powers . | |
| 2,646,241 | 7/1953 | McLean . | |
| 2,738,987 | 3/1956 | McDonald | 248/292.14 X |
| 2,787,433 | 4/1957 | Slavsky et al. . | |
| 2,845,729 | 8/1958 | Baumgart . | |
| 3,082,989 | 3/1963 | Bower . | |
| 3,102,351 | 9/1963 | Howell . | |
| 3,113,677 | 12/1963 | Johnson | 248/214 X |
| 3,529,798 | 9/1970 | Williams et al. . | |
| 3,669,392 | 6/1972 | Saunders . | |
| 3,969,838 | 7/1976 | Moore . | |
| 4,344,244 | 8/1982 | Tyke . | |
| 4,369,948 | 1/1983 | Krauss et al. . | |
| 4,531,311 | 7/1985 | Howard et al. . | |
| 4,574,507 | 3/1986 | Elliott . | |
| 4,593,486 | 6/1986 | Visocky et al. . | |
| 4,616,799 | 10/1986 | Rebentisch . | |
| 4,709,891 | 12/1987 | Barnett . | |
| 4,729,183 | 3/1988 | Tarter et al. . | |
| 4,791,739 | 12/1988 | Hetzer . | |
| 4,798,013 | 1/1989 | Sainato . | |
| 4,805,331 | 2/1989 | Boggess et al. . | |
| 4,821,437 | 4/1989 | Abramson et al. . | |
| 4,866,867 | 9/1989 | Clark . | |
| 4,869,376 | 9/1989 | Valiulis et al. . | |
| 4,881,707 | 11/1989 | Garfinkle . | |
| 4,884,351 | 12/1989 | Abramson . | |
| 4,909,464 | 3/1990 | Levine et al. . | |
| 4,957,256 | 9/1990 | Boeding . | |
| 5,106,046 | 4/1992 | Rowles et al. . | |
| 5,111,606 | 5/1992 | Reynolds . | |
| 5,143,337 | 9/1992 | Tomayko et al. | 248/291.1 X |
| 5,189,822 | 3/1993 | Schmanski et al. . | |
| 5,230,174 | 7/1993 | Reed . | |
| 5,237,767 | 8/1993 | Kringel et al. . | |
| 5,383,793 | 1/1995 | Hsu et al. . | |
| 5,408,775 | 4/1995 | Abramson et al. . | |
| 5,472,289 | 12/1995 | Kringel et al. . | |
| 5,803,420 | 9/1998 | Conway et al. | 248/291.1 X |

*Primary Examiner*—Derek J. Berger
*Attorney, Agent, or Firm*—Welsh & Katz, Ltd.

[57] ABSTRACT

A sign mounting system for pivotally mounting a sign to an associated storage rack includes a bracket having substantially vertical and horizontal legs contiguous with one another, and a mounting arm pivotally mounted to the bracket by a pivot pin. The bracket legs each define a free end having an engaging portion disposed at about each free end. The bracket further defines a mounting arm receiving region and a pin receiving region at about a juncture of the legs. The mounting arm has an elongated mounting member configured for securing a sign thereto and a pivot portion at an end of the mounting arm. The pivot portion includes first and second engaging portions adapted to engage the vertical and horizontal leg engaging portions, respectively. The pivot pin is mounted to the mounting arm and pivotal about the bracket for positioning and securing the sign in an upwardly oriented storage position and a downwardly oriented display position. The arm engaging portions frictionally engage their leg engaging portions to maintain the sign in the display and storage positions.

15 Claims, 2 Drawing Sheets

PIVOTAL, TWO-POSITION LOCKING SIGN MOUNTING SYSTEM

FIELD OF THE INVENTION

This invention pertains to a pivotal, two-position locking sign mounting system. More particularly, the invention pertains to a sign mounting system that permits a sign to be locked into a generally upwardly oriented storage position and a generally downwardly oriented display position.

BACKGROUND OF THE INVENTION

Signs, and more particularly point-of-purchase sign or display systems can, when properly designed, be tremendously effective marketing tools. As such, these point-of-purchase sign or display systems have become widely popular in all manner of retail trades.

There are an extremely large number of different types of point-of-purchase displays and signs. These displays vary from active, e.g. rotating, displays used to display, for example, eyewear, to the more traditional, passive or stationary signs such as overhead signs.

Consumers will also recognize the fast-paced growth of the home improvement center retail market, as well as the increasing number of "warehouse club"—types of establishments. Many of these establishments use conventional warehouse-type stocking arrangements. That is, they use shelving systems that permit loading of pallets and palletized items onto the stocking shelves.

Although these pallet-type stocking arrangements permit the storage of large items and a large amount of items on each of the shelves, in many instances, they do not lend themselves to the mounting of point-of-purchase displays or signs onto these shelving systems.

Typically, these point-of-purchase displays are permanently or semi-permanently affixed to the shelves themselves, are hung in aisles between shelving systems or racks, or are hung above the shelving systems and angled downwardly so that consumers may view the signs as they pass between the shelving racks. While many of these signs work quite well insofar as directing consumers' attention to particular products, they do not permit ready access to the shelves in order to, for example, restock the shelves. This, of course, is particularly true of those signs that are permanently or semi-permanently affixed to the shelves.

One known type of mounting system has a pivoting mount that includes a bracket that is permanently affixed to a vertical surface of the shelf system, and an upwardly extending arm connected to the bracket. A leg extends horizontally outwardly from the arm and includes a pivoting head portion attached to an end of the leg. A sign is mounted to the pivoting head portion so that the sign and head can be pivoted relative to the extension arm and leg.

The mounting system includes various pieces of hardware that are used to lock the sign and pivoting head into a desired position. Although such a sign support or mounting system may function well, it has a number of drawbacks. First, there is a large quantity of small hardware items that are required to mount the sign in a given position. Such small hardware items are easily lost or misplaced while the sign is pivoted to reposition the sign or to restock the shelves.

Another drawback is that the sign cannot be fully pivoted out of the way in order to restock a shelf. That is, when the sign is pivoted out of the way, it is typically pivoted and positioned horizontally, and can project outwardly, into for example an aisle. This "resting" position of the sign can create a personnel hazard, as well as place the sign in a position in which it can be damaged by passing equipment such as a forklift.

Other types of sign mounting systems are known in the art. However, such systems suffer from many of the same drawbacks as the aforementioned pivoting display mount. That is, small hardware items are necessary to position the sign in a particular, desired position, and/or the sign may not be fully pivotal out of the way of consumers, personnel working nearby or equipment that may be used in proximity to the pivoted sign.

Accordingly, there exists a need for a point-of-purchase display or sign mounting system that is used to position a sign in a particular, desired orientation and position, and that is effective for point-of-purchase marketing. Desirably, such a system permits fully rotating or pivoting the sign out of the way, from a display position to a storage position, to restock a shelf over which the sign is located. Such a mounting system requires minimal hardware to mount the sign to an associated shelving system, and further requires minimal hardware to move or pivot the sign from a display position to a storage position.

BRIEF SUMMARY OF THE INVENTION

A sign mounting system for mounting a sign to an associated storage rack horizontal beam includes a bracket that is affixed to the beam and a mounting arm that is pivotally mounted to the bracket by a pivot pin. The present mounting system permits securely positioning or locking a sign in a generally downwardly oriented display position and rotating or pivoting the sign into a generally upwardly oriented storage position. The sign is readily pivoted between the display and storage positions without the use of tools. Likewise, the mounting system can be installed on the associated rack without the use of tools. Advantageously, in a preferred mounting arrangement, the sign, whether in the display or storage position, is out of the way of passing individuals and equipment, such as a forklift, thus reducing the opportunity to damage the sign.

The bracket has substantially vertical and horizontal legs contiguous with one another and connected at a juncture thereof. Each leg defines a free end having an engaging portion disposed at about each free end. The bracket further defines a mounting arm receiving region and a pin receiving region at about the juncture of the legs.

The mounting arm has an elongated mounting member and a pivot portion. The mounting member is configured for securing a sign thereto. The pivot portion is disposed at an end of the mounting arm and includes first and second engaging portions adapted to engage the vertical and horizontal leg engaging portions, respectively.

The pivot pin is mounted to the mounting arm so that the arm is pivotal about the bracket, and is disposed within the bracket pin receiving region. This arrangements permits the mounting arm to pivot about the bracket between the storage position and the display position. The bracket engaging portions and the mounting arm engaging portions provide for frictionally engaging respective portions to maintain the mounting arm in the display position and for engaging the other of the respective portions to maintain the mounting arm in the storage position.

In one embodiment of the mounting system a locking flange is formed in the mounting arm intermediate the mounting member and the pivot portion, and the engaging portions are formed as part of the flange. In this embodiment, the horizontal leg engaging portion includes a locking ledge, and the vertical leg engaging portion includes a resting support portion. The flange can include a first hook-shaped portion for engaging the locking ledge and a second hook-shaped portion for engaging the resting support portion.

In this embodiment, the pin receiving region is configured so that the pivot pin is movable upwardly toward vertical leg engaging portion and is restricted from horizontal movement toward the horizontal leg engaging portion. An abutment element can be provided to restrict the horizontal movement of the pin.

In an alternate embodiment of the sign mounting system, the pivot pin is vertically and horizontally stationary, and the sign is maintained in place in the display and storage positions by frictional fit of the arm and bracket engaging portions. In this embodiment, the arm first engaging portion includes a receiving region that provides two surface engagement of the arm and bracket to maintain the sign in the storage position.

The bracket can be formed having a pair of channels along the horizontal and vertical legs having at least one slot associated with each channel. The channels and slots receive an associated flexible mounting element, such as a cable tie, for mounting the bracket to the storage rack beam. The channels further define the mounting arm receiving region. Alternately, the bracket can be formed with openings therein for mounting the bracket to the beam with fasteners such as screws, bolts and the like.

The present sign mounting system advantageously permits locking the sign into the downwardly oriented display position for readily viewing the sign, and, without the use of tools, pivoting into and securing the sign in the upwardly oriented storage position. The storage position of the sign permits readily restocking a shelf over which the sign is mounted.

Other features and advantages of the present invention will be apparent from the following detailed description, in conjunction with the accompanying drawings, and the appended claims.

DETAILED DESCRIPTION OF THE PREFERRED EMBODIMENTS

Figure 1:
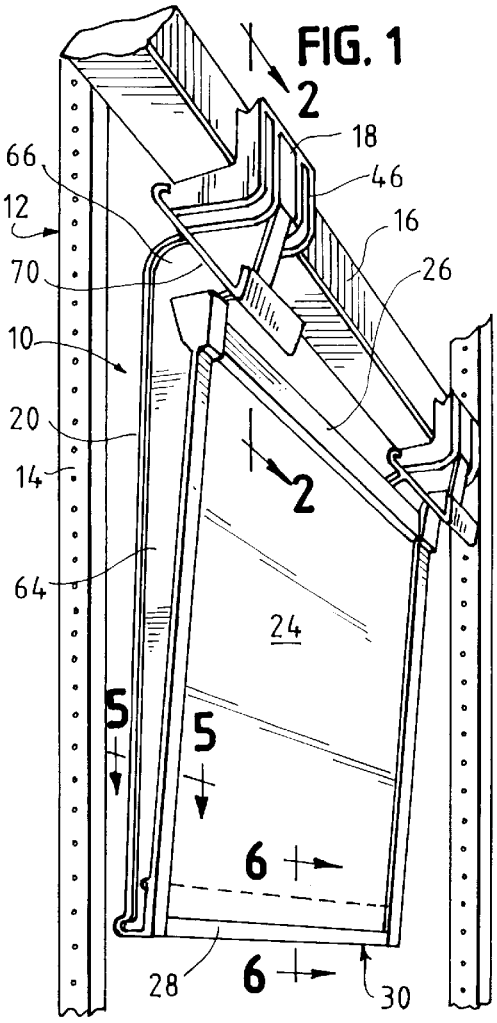
FIG. 1 is a perspective view of an embodiment of a pivotal, two-position locking sign mounting system embodying the principles of the present invention, the system being illustrated mounted to an associated pallet rack, and with the sign in the display position.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures, and in particular to FIG. 1, there is shown one embodiment of a pivotal, two-position locking sign mounting system 10 embodying the principles of the present invention. The mounting system 10 is shown affixed or mounted to a rack or shelving system 12 that is commonly referred to in the relevant art as a pallet rack. The pallet rack 12 includes vertical support members 14 and one or more horizontal beams 16 from which the shelves may be supported and from which the present mounting system 10 is supported.

The sign mounting system 10 includes, generally, a mounting bracket 18 that is affixed to the pallet rack beam 16 and a pair mounting arms 20. Each arm 20 is operably connected to a respective bracket 18 by a pivot pin 22. A sign 24, such as a sheet, is positioned in and mounted to the arms 20 by upper and lower support elements 24, 26, respectively, that extend between the arms 20. As seen in FIG. 1, the mounting arms 20 in conjunction with the upper and lower elements 24, 26 define a frame-like structure, indicated generally at 30, for securing the sign 24 to the mounting system 10.

Figure 7:
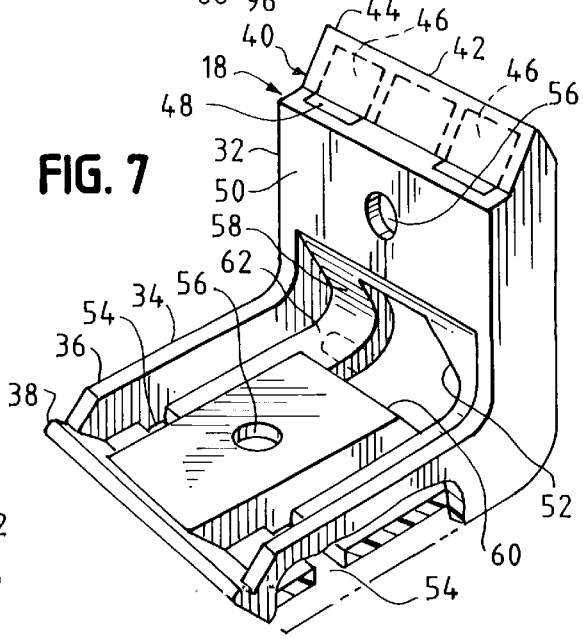
FIG. 7 is a perspective view, shown in partial fragmentary view, of the sign mounting system angle bracket of the present invention.

Referring briefly to FIG. 7, the mounting bracket 18 has a general L-shape, defined by a vertical leg 32 that is contiguous with a horizontal leg 34. The inner surfaces of the legs abut the pallet rack horizontal beam 16 to maintain the bracket 18 in place on the beam 16. At a free end 36 of the horizontal leg 34, the bracket 18 includes a rearwardly and upwardly extending locking ledge 38. The ledge 38, the function of which will be described in more detail herein, extends upwardly above the plane of the horizontal leg 32 inner surface. In this manner, as illustrated in FIG. 2, when the bracket 18 is mounted to the beam 16, the locking ledge 38 extends rearwardly beyond a rear surface of the beam 16.

A free end 40 of the vertical leg 32 includes a resting support portion 42. The resting support 42, as shown in the illustrated embodiment, terminates in an apex or point 44, the function of which will be described in more detail herein. From the description herein, those skilled in the art will recognize that the resting support portion 42 can be formed in a variety of configurations, which configurations are within the scope of the present invention.

In a present embodiment, the bracket 18 includes channels 46 formed in the vertical leg 32 that are contiguous with openings or slots 48 disposed therein between the resting support 42 and the inner surface 50. The channels 46 are spaced from one another and define a mounting arm receiving opening 52 therebetween. The channels 46 continue and extend along a portion of the horizontal leg 34 and are contiguous with openings or slots 54 adjacent the locking ledge 38. The channels 46 and slots 48, 54 accommodate a strap, such as the exemplary cable tie or cable wrap W for securing the bracket 18 to the beam 16. Alternately, the bracket 18 can include openings 56 in the horizontal 34 and/or vertical 32 legs, through which fasteners (not shown), such as screws, bolts and the like, can be inserted to secure the bracket 18 to the pallet rack beam 16.

Figure 2:
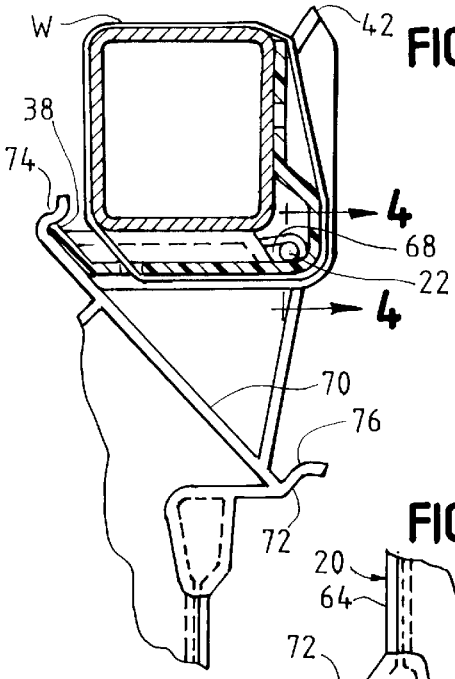
FIG. 2 is a cross-sectional view of the pivotal sign mounting system of FIG. 1 taken along line 2—2 of FIG. 1, the mounting system being illustrated with the sign in the display position.
Figure 3:
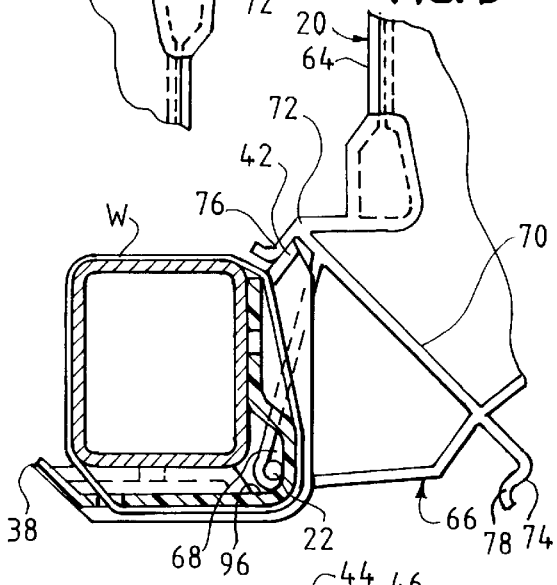
FIG. 3 is cross-sectional view of the pivotal sign mounting system similar to FIG. 2, but with the sign being illustrated in the storage or restocking position.
Figure 4:
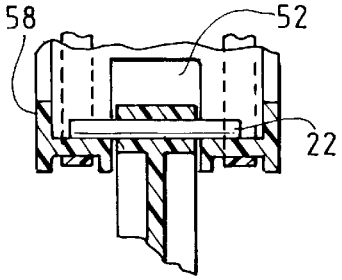
FIG. 4 is a rear view, in partial cross-section, of the sign mounting system, taken along line 4—4 of FIG. 2.

Referring now to FIGS. 2 and 3, the bracket 18 is formed with a pin receiving region 58. In the illustrated embodiment, the pin receiving region 58 extends across the mounting arm receiving opening 52, and is bounded by a portion of each the horizontal leg 34 and the vertical leg 32. The receiving region 58 is configured so that the pin 22 can travel a distance upward, toward the resting support 42. Rearward travel of the pin 22 is restricted or limited by an abutment 60 that is formed as part of the horizontal leg 34. As illustrated in FIGS. 3 and 4, the pin receiving region 58 forms a pocket 62 that permits upward, i.e., vertical, movement of the pin 22 away from the horizontal leg 34, while restricting or limiting rearward, i.e., horizontal, movement of the pin 22.

Each mounting arm 20 includes an elongated mounting member 64 on which the sign 24 is mounted and a pivoting portion 66 that operably connects to and pivots within the bracket 18. The pivoting portion 66 includes an opening 68 therein adapted to receive the pivot pin 22. In a preferred embodiment, the pivot pin 22 is formed from a metallic material, such as steel. Alternately, the pivot pin 22 can be formed integral with and as part of the mounting arm 20. The pivot portion 66 is separated from the mounting member 64 by a locking flange 70.

The locking flange 70 includes first and second engaging portions 72, 74, that are configured to engage the resting support 42 and the locking ledge 38, respectively, to maintain the sign 24 in the storage position (as illustrated in FIG. 3) and the display position (as illustrated in FIG. 2), respectively. Preferably, the first and second engaging portions 72, 74 are hook-shaped portions as illustrated at 76 and 78, respectively, formed in the flange 70. As seen in FIG. 1, the flange 70 has a width that is about equal to the width of the bracket 18. This arrangement provides a substantial area over which the mounting arm 20 and bracket 18 engage one another, thus reducing any localized stresses that may otherwise develop in the material.

The pivot portion 66, as seen in FIG. 4, has a width that is slightly smaller than the width of the mounting arm receiving opening 52, which width permits the pivot portion 66 to be received therein. The pivot pin 22 extends through the pin opening 68 and engages the bracket 18, resting within the pin receiving region 58. This configuration permits the pivot portion 66, and thus the mounting arm 20 to pivot within the bracket 18.

Figure 5:
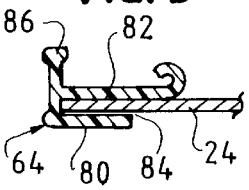
FIG. 5 is a partial cross-sectional view of the vertical portion of the sign mounting arm, taken along line 5—5 of FIG. 1.

Referring now to FIG. 5, each mounting member 64 is formed having forward and rear support flanges 80, 82, respectively, that define a space, as indicated at 84, therebetween for receiving the sign 24. The space 84 defines a pocket in which the sign 24 is held, securing it in place to the arms 20. The mounting member 64 can include a rearward extending structural projection 86 that provides additional rigidity to the arm 20.

Figure 6:
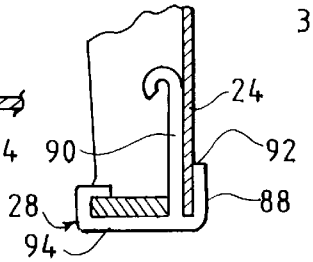
FIG. 6 is a partial cross-sectional view of the lower sign support element, taken along line 6—6 of FIG. 1.

The upper and lower support elements 26, 28, exemplary of which is the lower support element 28 illustrated in FIG. 6, are formed in a manner similar to the support arm 20. That is, the upper and lower support elements 26, 28 can be formed with forward and rear support flanges 88, 90 that define a space 92 therebetween for receiving the sign 24. The space 92 defines a pocket in which the top and bottom of the sign 24 are held, securing the sign in place. The support elements 26, 28 can include rearward extending structural projections 94 that provide additional rigidity to the elements 26, 28. Advantageously, in conjunction with the structural support of the support arms 20, these relatively rigid support elements 26, 28 permit use of the present mounting system 10 with relatively large signs that are, for example, over four feet wide and two feet high.

In a present embodiment, the bracket 18 and mounting arm 20 are formed using known molding techniques, such as injection molding, and are formed of common polymeric materials such as, acrylonitrile-butadiene-styrene copolymer ("ABS"), polyvinyl chloride ("PVC"), and the like. The upper and lower support elements 26, 28 can be formed using an extrusion technique and can also be formed from ABS, PVC and the like. These plastic/polymer forming techniques, as well other materials used therefor will be recognized by those skilled in the art.

Use of the present sign mounting system 10 is relatively simple. A sign 24 is fitted with the upper and lower support elements 26, 28, and the sign and support element assembly is fitted into the mounting arms 20. The mounting brackets 18 are then affixed to the rack beam 16. As provided above, the brackets 18 can be affixed to the beam 16 using cable ties W that are positioned in the bracket channels 46 and inserted through the bracket slots 48, 54. Alternately, the bracket 18 can be mounted to the beam 18 using fasteners (not shown), such as screws, bolts and the like.

In the display position, as illustrated in FIG. 2, the sign 24 is pivoted rearwardly until the second engaging portion 74 of the flange 70 engages the locking ledge 38. When the hook 78 is engaged with and urged over the ledge 38, the sign 24 is locked into the display position. That is, the hook 78 snaps into place over the ledge 38, and frictionally secures the sign 24 in the display position. As seen in FIG. 1, the sign 24 is offset rearwardly from the plane of the bracket 18. In this arrangement, the sign 24, when in the display position, is disposed rearward of the plane of the front of the pallet rack 12. That is, the sign 24 is positioned just inside the shelf line, and is oriented slightly rearward of the vertical orientation.

When it is desired to rotate the sign 24 out of the display position to, for example, restock the shelf over which the sign is displayed, the sign 24 is urged forward so that each hook 78 disengages from its respective bracket's locking ledge 38, and sign 24 is rotated upwardly, toward the storage position as illustrated in FIG. 2. As the sign 24 is rotated upwardly, the arm 20 is moved upwardly, so that the pin 22 moves upwardly within the pin receiving region 58, off of the inner surface 96 of the horizontal leg 34. As the arm 20 is moved upwardly, the flange first engaging portion 72 is raised above the resting support 42, and is then lowered back down onto the support 42 to rest thereon. As seen in FIG. 3, in this position, the sign 24 is maintained in the storage position.

Advantageously, when the sign 24 is oriented to the display position, it is out of the aisle immediately in front of the rack 12 from which it is viewed. Given that these pallet racks 12 are often restocked by using a forklift or like vehicle, there is considerably less opportunity to strike and consequently damage the sign 24, because it is oriented or angled away from the aisle. In addition, many. such signs 24 are positioned overhead, for example, at a highest or nearhighest shelf level so that the signs 24 are visible from the greatest possible distance. Although generally, greater heights provide increased visibility from greater distances, it can nevertheless make it quite difficult to read or view a sign 24 when standing immediately below the sign 24. The slight rearward angle of the sign 24 facilitates viewing the sign 24 from below or in close proximity to a position below the sign 24.

Figure 8:
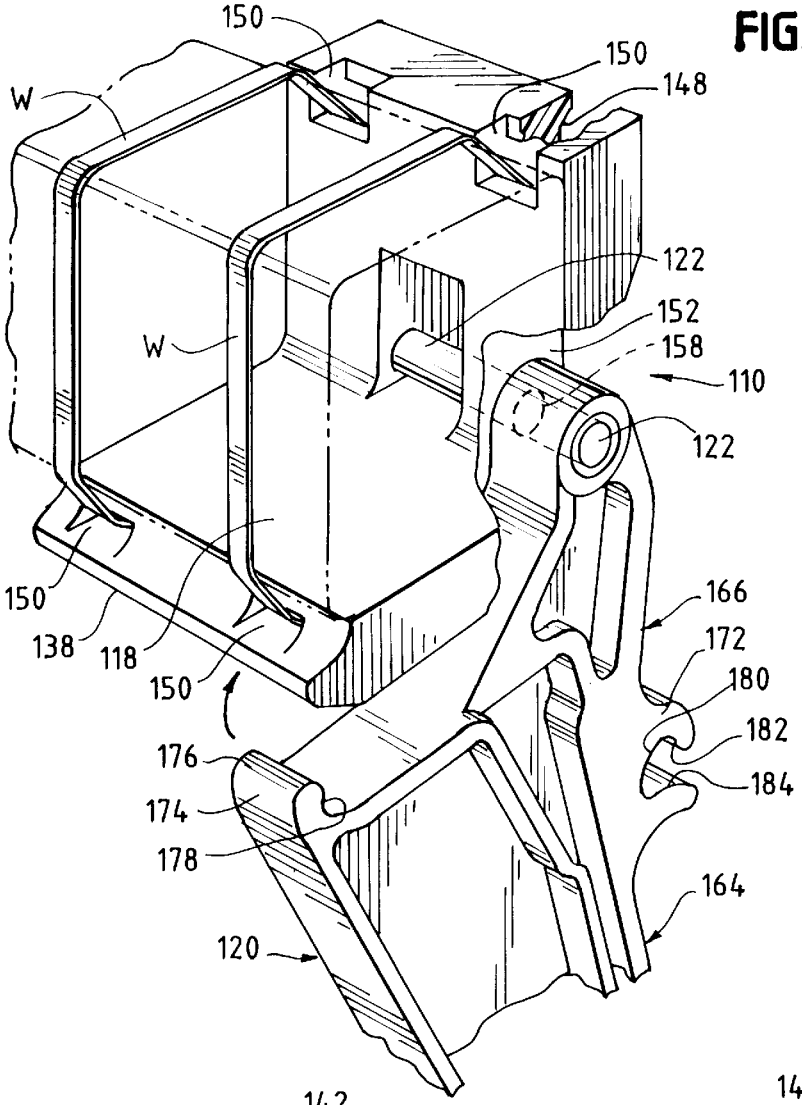
FIG. 8 is a perspective view of an alternate embodiment of the pivotal, two-position locking sign mounting system embodying the principles of the present invention, the system being illustrated mounted to an associated pallet rack, and with the sign being rotated into the display position.
Figure 10:
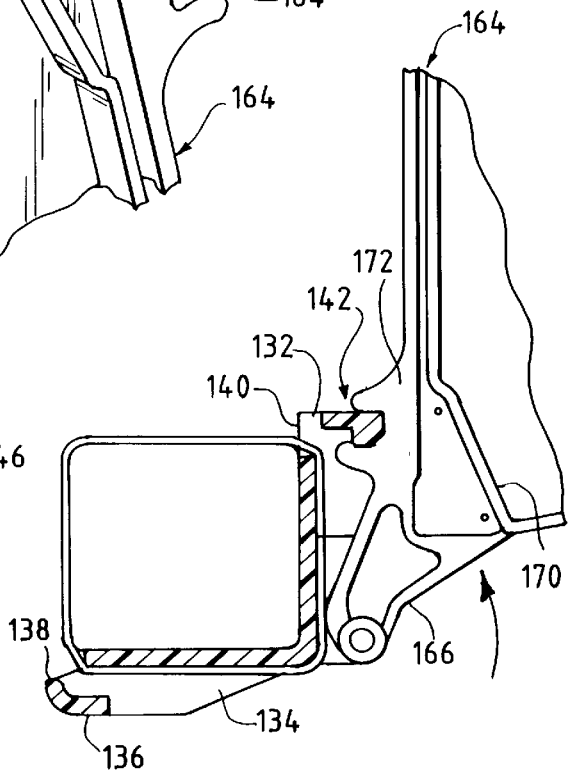
FIG. 10 is a view similar to FIG. 9 illustrating the sign in the storage or restocking position.
Figure 9:
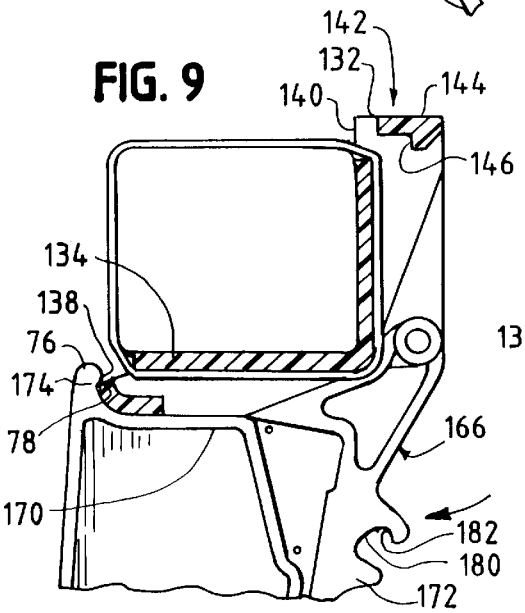
FIG. 9 is a fragmentary view shown in partial cross-section illustrating the sign mounting system of FIG. 8 with the sign rotated into the display position.

An alternate embodiment 110 of the sign mounting system is illustrated in FIGS. 8–10. The alternate embodiment 110 includes a mounting bracket 118 that is affixed to the pallet rack beam 16 and a mounting arm 120 that is operably and pivotally connected to the bracket 118 by a pivot pin 122. Similar to the bracket 118 illustrated in FIGS. 2, 3 and 7, the bracket 118 has a general L-shape, defined by a vertical leg 132 that is contiguous with a horizontal leg 134. The inner surfaces of the legs 132, 134 abut the pallet rack beam 16 to maintain the bracket 118 in place thereon. A free end 136 of the horizontal leg 134 includes a rearwardly and upwardly extending locking ledge 138. A free end 140 of the vertical leg 132 includes an upper-most engaging region or locking portion 142. The upper locking portion 142 extends essentially across the width of the bracket 118 and includes an upper wall 144 and an opposing, downwardly oriented hook portion 146.

The bracket 118 further includes channels 148 formed in the horizontal and vertical legs 134, 132 that are contiguous with openings or slots 150 for receiving, for example, the exemplary straps W to secure the bracket 118 to the beam 16. Alternately, the bracket 118 can include openings (not shown) in the horizontal and/or vertical legs 134, 132, through which fasteners (not shown), such as screws, bolts and the like, can be inserted to secure the bracket 118 to the rack system beam 16.

An arm receiving region 152 is defined at about the juncture of the horizontal 134 and vertical legs 132 and includes a pin opening 158 for receiving the pivot pin 122. The opening 158 extends in a generally horizontal plane when the bracket 118 is mounted to the beam 16. The arm receiving region 152 is defined, in part, by the channels 148 and thus has an overall width that is smaller than the width of the bracket 118.

The mounting arm 120 is similar to the arm 20 illustrated in FIGS. 1–4, and includes an elongated mounting member 164 on which the sign (not shown) is mounted and a pivoting portion 166 that operably connects to and pivots about the bracket 118. The pivoting portion 166 includes an opening 168 therein adapted to receive the pivot pin 122.

Adjacent to the pivot portion 166, the arm 120 includes a locking portion 170 having first and second engaging portions 172, 174 that are configured to engage the bracket upper locking portion 142 and the locking ledge 138, respectively, to maintain the sign in the storage and display positions, as illustrated in FIGS. 10 and 9. Preferably, the second engaging portion 174 is hook-shaped, as indicated at 176, and includes a shoulder 178 that is adapted to engage the locking ledge 138 and retain the sign in the display position.

The first engaging portion 172 defines a receiving region 180 having a retaining lip 182 and an opposingly oriented abutting wall 184. When in the storage position, the retaining lip 182 engages the upper locking portion hook 146 and the abutting wall 184 lies adjacent and abuts the upper wall 144 of the bracket 118. In this manner, the arm 120 frictionally engages the bracket 118 along two surfaces 144, 146 to maintain and secure the sign in the storage position.

The pivot and locking portions 166, 170, and preferably, the entire mounting arm 120, as seen in FIG. 8, have a relatively narrow width compared to the bracket 118. In this manner, the arm 120 can be mounted to either side of the bracket 118, without the arm 120 extending outwardly a significant distance beyond the sides of the bracket 118. This arm configuration also provides flexibility in installation of the sign mounting system 110 in that the arm 120 can be mounted to the bracket 118 at either side of the arm receiving region 152. Advantageously, the narrow arm width reduces the amount of material needed to mold the arm 120 and thus reduces the overall cost of fabricating the system 110.

It will be apparent from the drawings and the present disclosure that although the system 10, 110 is illustrated installed to a horizontal beam 16, it can also be used mounted to a vertical support post, such as the post 14. Such a mounting arrangement is within the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A sign mounting system for use with an associated storage rack having a horizontal support member, the sign mounting system configured for mounting a sign thereto, comprising:

a bracket having substantially vertical and horizontal legs contiguous with one another, each leg defining a free end and having an engaging portion disposed at about each free end, the bracket further defining a mounting arm receiving region and a pin receiving region at about a juncture of the legs;

a mounting arm having an elongated mounting member and a pivot portion, the mounting member configured for securing a sign thereto, the pivot portion disposed at an end of the mounting arm and including first and second engaging portions adapted to engage the vertical and horizontal leg engaging portions, respectively; and a pivot pin mounted to the mounting arm and to the bracket for pivoting the arm relative to the bracket, the pin being disposed within the pin receiving region when the mounting arm pivot portion is disposed within the mounting arm receiving region, wherein the mounting arm is pivotal about the bracket and is movable relative thereto into an upwardly oriented storage position and is pivotal about the bracket to a downwardly oriented display position, and wherein the second engaging portion frictionally engages the horizontal leg engaging portion to maintain the mounting arm in the display position and the first engaging portion engages the vertical leg engaging portion to maintain the mounting arm in the storage position.

2. The sign mounting system in accordance with claim I including a locking flange formed in the mounting arm intermediate the mounting member and the pivot portion.

3. The sign mounting system in accordance with claim I wherein the bracket horizontal leg engaging portion includes a locking ledge, and wherein the second engaging portion includes a hook-shaped element adapted to engage the locking ledge.

4. The sign mounting system in accordance with claim 1 wherein the bracket vertical leg engaging portion includes a resting support, and wherein the first engaging portion includes a hook-shaped element adapted to engage the resting support.

5. The sign mounting system in accordance with claim 1 wherein the pin receiving region is configured so that the pivot pin is movable upwardly toward the vertical leg engaging portion and is restricted from horizontal movement toward the horizontal leg engaging portion.

6. The sign mounting system in accordance with claim 5 wherein the bracket includes an abutment portion adapted to restrict horizontal movement of the pivot pin.

7. The sign mounting system in accordance with claim 1 wherein the bracket is formed to define a pair of channels disposed on either side of the mounting arm receiving region, and is further formed to define at least one slot associated with each channel, the channels and slots configured to receive an associated flexible mounting element for mounting the bracket to the storage rack horizontal support member.

8. The sign mounting system in accordance with claim 1 wherein the bracket includes mounting openings therein.

9. A sign mounting system for use with an associated storage rack having a horizontal support member, the sign mounting system configured for mounting a sign thereto, comprising:

a bracket having substantially vertical and horizontal legs contiguous with one another, each leg defining a free end, each leg having an engaging portion disposed at about each free end, the bracket further defining a mounting arm receiving region and a pin receiving region at about a juncture of the legs;

a mounting arm having an elongated mounting member and a pivot portion, the mounting member configured for securing a sign thereto, the pivot portion disposed at an end of the mounting arm and including first and second engaging portions adapted to engage the vertical and horizontal leg engaging portions, respectively; and a pivot pin disposed within the pin receiving region for pivotally mounting the mounting arm to the bracket, wherein the mounting arm is pivotal about the bracket between an upwardly oriented storage position and a downwardly oriented display position, and wherein the pivot portion frictionally engages the horizontal leg engaging portion to maintain the mounting arm in the display position and engages the vertical leg engaging portion to maintain the mounting arm in the storage position.

10. The sign mounting system in accordance with claim 9 wherein the bracket horizontal leg engaging portion includes a locking ledge, and wherein the second engaging portion includes a hook-shaped element adapted to engage the locking ledge.

11. The sign mounting system in accordance with claim 9 wherein the bracket vertical leg engaging portion includes an upper locking portion and wherein the first engaging portion includes a receiving region having a retaining lip and an opposingly oriented abutting wall for frictionally engaging the upper locking portion along two surfaces to maintain the arm in the storage position.

12. The sign mounting system in accordance with claim 9 wherein the bracket is formed to define a pair of channels and at least one slot associated with each channel, the channels and slots configured to receive an associated flexible mounting element for mounting the bracket to the storage rack horizontal support member.

13. A sign mounting system for use with an associated storage rack having a support member, the sign mounting system configured for mounting a sign thereto, comprising:

a bracket having substantially perpendicular first and second legs contiguous with one another, each leg defining a free end, each leg having an engaging portion disposed at about its respective free end, the bracket further defining a mounting arm receiving region and a pin receiving region at about a juncture of the legs;

a mounting arm having an elongated mounting member and a pivot portion, the mounting member configured for securing a sign thereto, the pivot portion disposed at an end of the mounting arm and including first and second engaging portions adapted to engage a respective leg engaging portion; and pivot means for pivotally mounting the mounting arm to the bracket, wherein the mounting arm is pivotal about the bracket between a first storage position and a second display position, and wherein the first and second engaging portions frictionally engage their respective leg engaging portions to maintain the mounting arm in one of the display position and the storage position.

14. The sign mounting system in accordance with claim 13 wherein one of the bracket leg engaging portions includes a locking ledge, and wherein the respective arm engaging portion includes a hook-shaped element adapted to engage the locking ledge.

15. The sign mounting system in accordance with claim 14 wherein the other of the bracket leg engaging portions includes a locking portion and wherein the respective arm engaging portion includes a receiving region adapted to frictionally engage the upper locking portion along two surfaces to maintain the arm in the storage position.

* * * * *